US006257381B1

(12) United States Patent
Harfst

(10) Patent No.: US 6,257,381 B1
(45) Date of Patent: Jul. 10, 2001

(54) BUSINESS CASE, PARTICULARLY COMPUTER CASE

(75) Inventor: Karl Hermann Harfst, Langgöns-Dornholzhausen (DE)

(73) Assignee: Consel Kofferloesungen GmbH (DE)

( * ) Notice: Subject to any disclaimer, the term of this patent is extended or adjusted under 35 U.S.C. 154(b) by 0 days.

(21) Appl. No.: 09/398,961

(22) Filed: Sep. 17, 1999

(30) Foreign Application Priority Data

Sep. 18, 1998 (DE) ..... 298 16 799 U

(51) Int. Cl.[7] ..... A45C 3/02; A45C 5/04; A45C 13/10

(52) U.S. Cl. ..... 190/108; 190/102; 190/110; 150/111

(58) Field of Search ..... 190/102, 108, 190/110; 150/111, 113; 24/105, 788

(56) References Cited

U.S. PATENT DOCUMENTS

| | | | | |
|---|---|---|---|---|
| 523,503 | * | 7/1894 | Alberschardt | 190/108 |
| 922,567 | * | 5/1909 | Cosgrove | 190/108 |
| 1,176,619 | * | 3/1916 | Sykes | 24/105 |
| 2,372,845 | * | 4/1945 | Nelson | 190/108 |
| 3,319,744 | * | 5/1967 | Smith | 190/108 |
| 3,837,447 | * | 9/1974 | Honan | 190/108 X |
| 4,744,446 | * | 5/1988 | Arney | 190/108 |
| 5,018,609 | * | 5/1991 | Brenner | 190/108 |
| 5,676,223 | * | 10/1997 | Cunningham | 190/110 X |
| 5,678,666 | * | 10/1997 | Shyr et al. | 190/108 X |
| 5,875,876 | * | 3/1999 | Wang | 190/108 X |
| 6,012,557 | * | 1/2000 | Derelanko | 190/102 X |

FOREIGN PATENT DOCUMENTS

| | | | | |
|---|---|---|---|---|
| 2342895 | * | 3/1975 | (DE) | 190/110 |
| 3600794 | * | 8/1986 | (DE) | 190/110 |

* cited by examiner

*Primary Examiner*—Sue A. Weaver

(57) ABSTRACT

Case combination has a main portion and an accessory portion, which can be connected together side by side. The main and accessory portions can also be used separated from each other.

10 Claims, 2 Drawing Sheets

Fig. 1
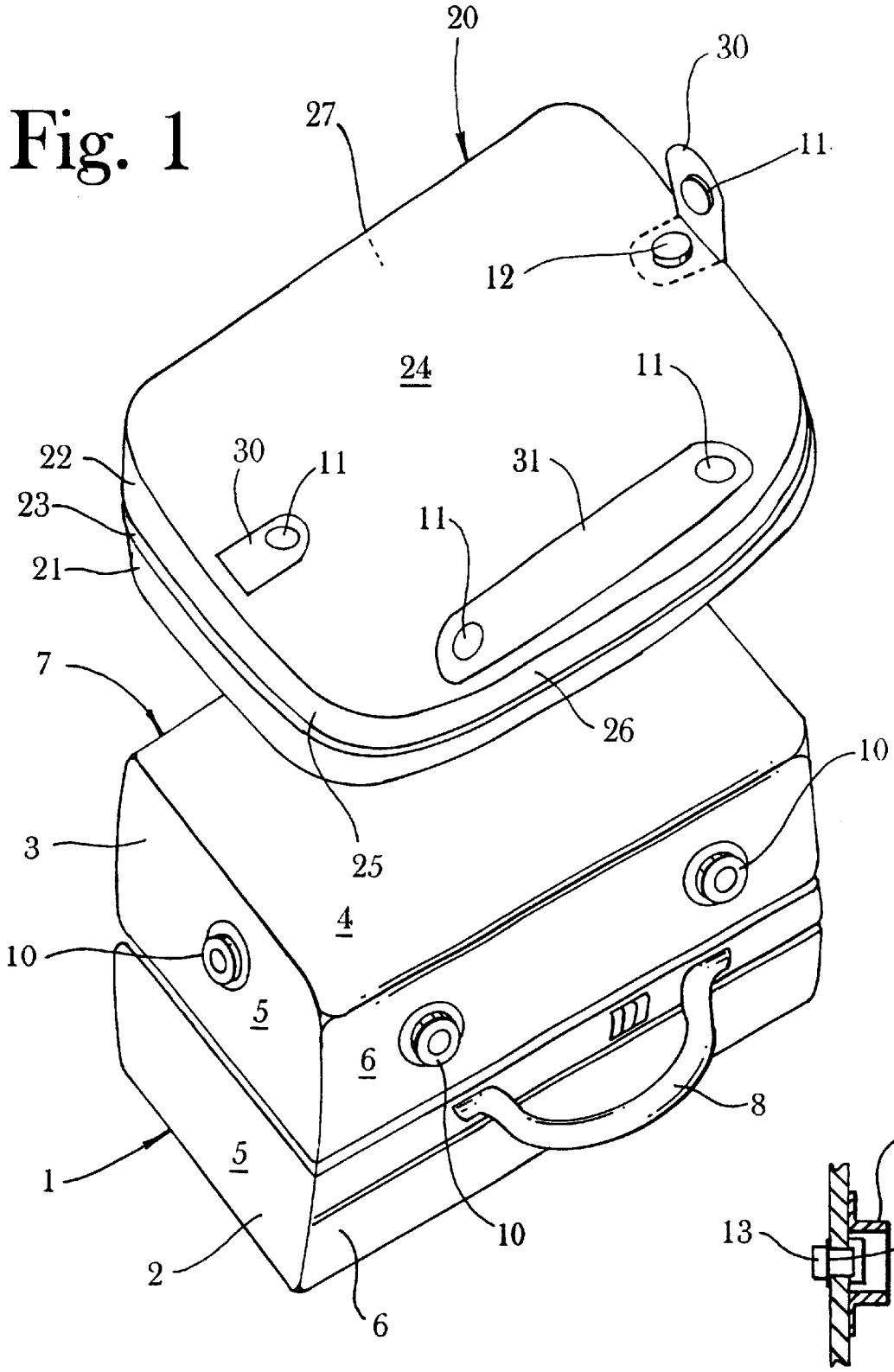
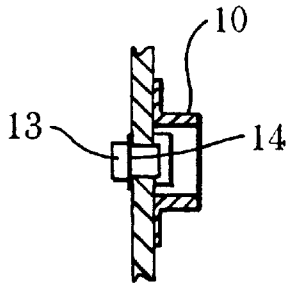
Fig. 2

BUSINESS CASE, PARTICULARLY COMPUTER CASE

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates to a business case, in particular, a computer case, containing a first portion as a main case, with two long sides, two narrow sides, an upper side and an underside, and also an accessory portion, likewise with two wide sides, two narrow sides, an upper side and an underside.

2. Discussion of Relevant Art

It is known to provide a hinge between the main portion and the accessory portion in file cases, the two portions of the said hinge being separable. The accessory portion consists of a box frame with a side which can be opened out, and which abuts a wide side of the main case when the cases are combined. The main and accessory portions are held together by the releasable hinge and in addition by a clasp fitted to the upper side of the two case portions. The main portion of the case can be used individually, and then appears like a conventional file case, while the accessory portion cannot be used by itself.

SUMMARY OF THE INVENTION

The invention has as its object to provide a combination that is suitable, in particular, to receive a computer (laptop or the like) and also associated devices, and whose individual components can be serviceable on their own as adequate transport containers.

The given object is attained in that the accessory portion is in the form of a portfolio or a briefcase, and that joining devices are installed on the upper side and also on the narrow sides of the main portion, on the one hand, and on the accessory portion on the other hand, in order to releasably join the accessory portion to the main portion.

The main portion preferably represents a computer case, to which the portfolio or the briefcase can be adjoined when there is a need for papers or associated devices, which are transported in the portfolio. However, the portfolio can also be used as a separate container.

Press fasteners and straps are preferred as the joining devices, and indeed the straps bridge over the distance between the main portion and the accessory portion. VELCRO-type closure portions can also be used instead of the press fasteners.

The portfolio or the briefcase has a zipper which preferably goes along three narrow sides. Two closure clasps can be installed on the zipper. In the case of a computer case, the accessory portion shelters an internal compartment for a disk drive.

A holder for a removable cellular phone is furthermore provided. Compartments for visiting cards and writing materials are also provided for its role as a portfolio or briefcase. A side pocket to receive papers can also be provided in the portfolio.

BRIEF DESCRIPTION OF THE DRAWINGS

The invention will be described with reference to the accompanying drawings, in which:

FIG. 1 shows a perspective, separated view of a computer case and a portfolio.

FIG. 2 shows an enlarged detail, of a section through a press fastener, and

DETAILED DESCRIPTION OF PREFERRED EMBODIMENTS

Figure 3:
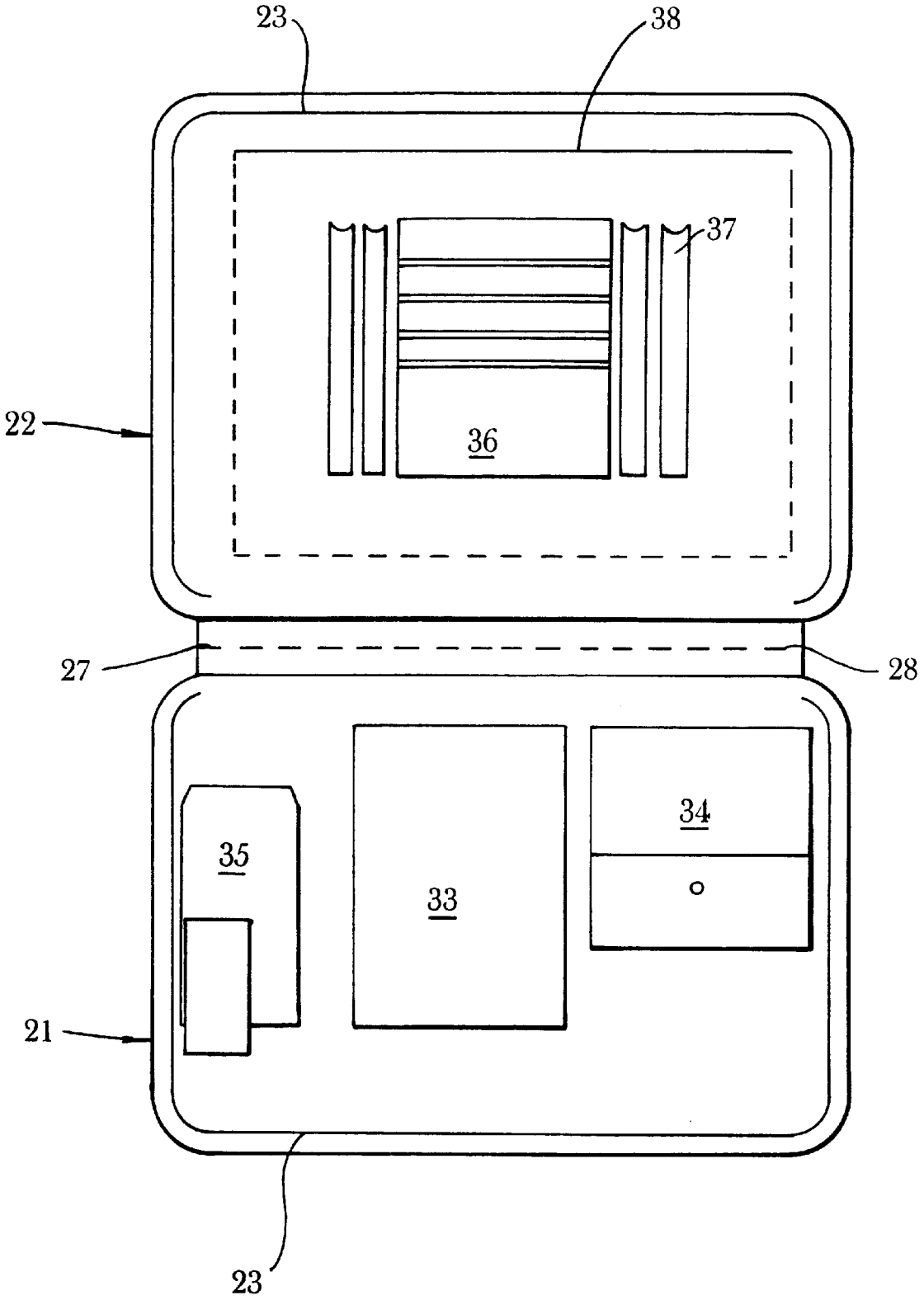
FIG. 3 shows a view of the interior of the portfolio.

FIG. 1 shows a computer case in the form of a box, with two halves 2 and 3, which are connected together by means of a hinge and a catch. There are two wide sides 4, two narrow sides 5, an upper side 6 and an underside 7 along which the hinge runs. A case handle 8 is fitted to the upper side of a case half 2. Press fasteners 10 are fitted to the narrow sides 5 and the upper side 6 of the other case half 3; their purpose is explained hereinbelow.

A portfolio 20 in the form of an underarm briefcase consists of two halves 21 and 22, which can be opened and closed by means of a zipper 23. Again, two wide sides 24, two narrow sides 25, an upper side 26 and an underside 27 are formed. The underside 27 has a linear region of great flexibility by which the hinge 28 between the two halves 21 and 22 is formed. The zipper 23 can include two closure clasps.

Straps 30 and 31 are fitted to the portfolio and carry opposing press fasteners 11 which fit together with the press fasteners 10 of the computer case 1. The strap 30 shown in FIG. 1 is raised, in order to show a press fastener 12 which is fitted to the wide side 24 of the portfolio and can cooperate with the press fastener 11. The attachment places of the straps 30, 31 are located near the edge of the wide side 24 to the narrow sides 25 and 26.

When the portfolio is turned through 180° and the straps 30, 31 are released from their press fasteners 12, the press fasteners 11 can be fixed to the press fasteners 10. The portfolio can be fastened onto the computer case 1 in this manner. The case 1 and the portfolio 20 can however be used independently of each other. For this purpose, the portfolio 20 is unfastened from the case 1 and the straps are fastened to the press fasteners 12.

The case 1 can also be purchased independently, without the press fasteners 10. In order to permit the case 1 to cooperate later on with the portfolio 20, holes closed with plugs are prepared in advance in the walls of the sides 5 and 6. Furthermore, there is a retrofitting set of a press fastener 10, a screw 13 and a nut 14. After removal of the plugs, the press fasteners 10 can be attached to the case 1 as shown enlarged in FIG. 2.

While joining devices by means of the use of press fasteners are preferred, there are also further possibilities of joining connections between the main case and the portfolio. A VELCRO type joining bond can be considered as such a possibility. Since press fasteners do not easily hook onto items of clothing, they are preferred over VELCRO type fastenings.

When the main case 1 is constituted as a computer case, the portfolio 20 supplements the computer case in a particularly appropriate manner. In the portfolio, a respective compartment 33, 34 can be provided for housing a disk drive and diskettes, a holder 35 can be provided for a removable cellular phone, compartments 36, 37 can be provided for business cards and writing media, and finally a further side pocket 38 can be provided to receive paper. The side pocket can be closed by a straight zipper.

The main portion of the case 1 and the accessory portion 20 can of course be equipped for purposes of use other than the computer purposes that have been mentioned. The two portions 1 and 20 can be transported together, but otherwise used separately.

I claim:

1. A case combination comprising:

a main portion including two compartment halves to be opened and closed and having walls that define two wide sides, two narrow sides, an upper side, and an underside, an accessory portion including two halves adapted to be opened and closed and having walls that define an outer wide side an inner wide side, two narrow sides, an upper side and an underside, said accessory portion being in a form of a portfolio or an underarm briefcase, and means that join said accessory portion to said main portion in a side-to-side relationship so that said inner wide side of said accessory portion lies close to one of said wide sides of said main portion, said joining means comprising a first fastener arrangement fixed to said upper side and said narrow sides of said main portion, said joining means further comprising a second fastener arrangement fixed to said accessory portion at, or near to, said outer wide side of said accessory portion, said joining means providing a releasable connection between said accessory portion and said main portion.

2. The case combination according to claim 1, wherein said fastener arrangement comprises a plurality of said first and second fasteners forming pairs, each pair of first and second fasteners including a pair of press fasteners cooperating together, each said second fasteners comprising a strap that is fixed on said accessory portion, on which strap one press fastener of said pair of press fasteners is fixed, said straps having lengths to span the distance between said accessory portion outer side and said main portion.

3. The case combination according to claim 2, wherein an edge is formed between said outer wide side and said narrow and upper sides of said accessory portion, each of said straps having a first end that is fixed to said accessory portion at, or adjacent to said edge, and a second end that carries one of said press fasteners of said pair.

4. The cage combination according to claim 3, wherein release means are provided to releasably attach said second ends of said straps onto said outer side of said accessory portion.

5. The case combination according to claim 2, wherein said first fasteners comprise press fasteners that are fixed to said main portion.

6. The case combination according to claim 1, wherein said accessory portion comprises a zipper over said narrow sides and said upper side of said accessory portion.

7. The case combination according to claim 1, wherein said accessory portion comprises in its interior a space for a compartment for a disk drive.

8. The case combination according to claim 1, wherein said accessory portion comprises in its interior a space for a holder for a removable cellular phone.

9. The case combination according to claim 1, wherein said accessory portion comprises in its interior compartments for business cards and writing media.

10. The case combination according to claim 1, wherein said accessory portion is comprises a side pocket to receive papers.

* * * * *